US009359809B2

(12) United States Patent
Richardson et al.

(10) Patent No.: US 9,359,809 B2
(45) Date of Patent: Jun. 7, 2016

(54) GARAGE DOOR AND FAUX WINDOW FAçADE ASSEMBY

(75) Inventors: Trevor Richardson, White Cloud, MI (US); Lee A. Chase, Grand Rapids, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 852 days.

(21) Appl. No.: 13/020,507

(22) Filed: Feb. 3, 2011

(65) Prior Publication Data

US 2012/0198772 A1 Aug. 9, 2012

(51) Int. Cl.
*E06B 3/70* (2006.01)
*E06B 3/48* (2006.01)

(52) U.S. Cl.
CPC ..... *E06B 3/7001* (2013.01); *E06B 3/485* (2013.01)

(58) Field of Classification Search
CPC ..... E06B 3/485; E06B 3/7001; E06B 3/549; E06B 3/5409
USPC ..... 52/64, 67, 69, 204.1, 208, 784.1; 160/201
See application file for complete search history.

(56) References Cited

U.S. PATENT DOCUMENTS

| | | | | | |
|---|---|---|---|---|---|
| 311,014 | A | * | 1/1885 | Koskul | 428/56 |
| 2,042,077 | A | | 5/1936 | Stoneback | |
| 2,134,397 | A | * | 10/1938 | Clark | 160/229.1 |
| 2,221,005 | A | | 11/1940 | Reese | |
| 2,266,973 | A | | 12/1941 | Horton | |
| 2,572,764 | A | | 10/1951 | Rogers et al. | |
| 2,925,862 | A | | 2/1960 | Sundby | |
| 3,178,776 | A | * | 4/1965 | Stansberry | 52/456 |
| 4,284,119 | A | * | 8/1981 | Martin et al. | 160/232 |
| 4,671,031 | A | * | 6/1987 | Intengan | 52/203 |
| 4,828,004 | A | * | 5/1989 | Martinez | 160/229.1 |
| 4,904,513 | A | * | 2/1990 | De Nicolo | 428/46 |
| 5,123,211 | A | * | 6/1992 | Schlicht et al. | 52/202 |
| 5,469,903 | A | * | 11/1995 | Stanley | 144/345 |
| 5,497,588 | A | | 3/1996 | Martin et al. | |
| 5,509,457 | A | * | 4/1996 | Jella | 160/201 |
| 5,555,923 | A | * | 9/1996 | Leist et al. | 160/229.1 |
| 5,598,667 | A | * | 2/1997 | Dykes | 52/71 |
| D378,853 | S | * | 4/1997 | Forsland | D25/48.4 |

(Continued)

*Primary Examiner* — Joshua J Michener
*Assistant Examiner* — Alp Akbasli
(74) *Attorney, Agent, or Firm* — Price Heneveld LLP

(57) ABSTRACT

A garage door and faux window façade assembly includes a door panel adapted to be mounted in a garage door opening partially defined by an overhead door structure, a triangularly-shaped clearance area defined by a first line segment substantially coplanar with a forwardly-facing surface of the door panel, and second and third line segments defined by a path of the overhead door structure relative to the door panel as the door panel moves between a closed position and an open position, wherein the second line segment is proximate the upper edge of the door panel and the third line segment is proximate the lower edge of the door panel, the clearance area is adapted to be free from abutment with the overhead door structure as the door panel moves between a closed position and an open position, and wherein the clearance area includes a forward portion area defined by the first and second line segments and a ⅜ inch line that extends perpendicularly from the first line segment and intersecting the second line segment, and a frame including at least a select one of a window aperture extending there through and a window recess formed thereon, wherein the frame extends into the forward portion area of the clearance area in at least one location along a length of the frame.

21 Claims, 6 Drawing Sheets

(56) References Cited

U.S. PATENT DOCUMENTS 5,626,176 A * 5/1997 Lewis et al. ..... 160/201
D380,053 S * 6/1997 Forsland ..... D25/48.3
5,787,677 A * 8/1998 Bolich et al. ..... 52/784.15
5,840,391 A * 11/1998 Eichhorn et al. ..... 428/38
6,026,886 A * 2/2000 Diamond-Martinez ..... 160/113
6,035,919 A * 3/2000 Zinbarg ..... 160/113
6,131,345 A * 10/2000 Pelusio ..... 52/204.59
6,148,896 A * 11/2000 Pinto et al. ..... 160/229.1
6,227,278 B1 * 5/2001 Forsland ..... 160/107
6,269,597 B1 8/2001 Haas
D452,979 S * 1/2002 Maher ..... D25/48.4
6,395,369 B1 * 5/2002 Randone ..... 428/99
6,397,541 B1 * 6/2002 Brewer ..... 52/316
6,446,695 B1 * 9/2002 Forsland ..... 160/201
6,586,085 B1 * 7/2003 Jella ..... 428/319.1
6,647,677 B1 * 11/2003 Berger, Jr. ..... 52/204.1
6,655,442 B2 * 12/2003 Snyder ..... 160/201
6,715,245 B2 * 4/2004 Lewkowitz ..... 52/208
6,763,638 B1 7/2004 Berger, Jr.
D493,896 S * 8/2004 Mock ..... D25/138
6,772,814 B2 * 8/2004 Leist et al. ..... 160/40
D497,676 S * 10/2004 Barnard ..... D25/60
D498,304 S * 11/2004 Mock ..... D25/48.4
D498,305 S * 11/2004 Mock ..... D25/48.4
D499,815 S * 12/2004 Miller et al. ..... D25/48.3
D500,857 S * 1/2005 Miller et al. ..... D25/48.3
D501,563 S * 2/2005 Miller et al. ..... D25/48.4
6,862,850 B2 * 3/2005 Berger, Jr. ..... 52/204.6
D506,010 S * 6/2005 Barnard ..... D25/48.7
D506,835 S * 6/2005 Barnard ..... D25/48.7
6,948,547 B2 9/2005 Maher
D510,442 S * 10/2005 Barnard ..... D25/48.7
D513,329 S * 12/2005 Barnard ..... D25/48.7
D513,534 S * 1/2006 Barnard ..... D25/48.7
D520,645 S * 5/2006 Mock ..... D25/48.4
D521,157 S * 5/2006 Mock ..... D25/48.4
D521,158 S * 5/2006 Mock ..... D25/48.4
7,040,373 B2 * 5/2006 Snyder ..... 160/113
7,107,736 B2 9/2006 Barnard
7,121,317 B2 * 10/2006 Mullet ..... 160/201
7,266,928 B1 9/2007 Stasiak, Jr.
7,299,853 B2 * 11/2007 Brown et al. ..... 160/201
D558,894 S * 1/2008 Mock ..... D25/48.4
D558,895 S * 1/2008 Mock ..... D25/48.4
D558,896 S * 1/2008 Mock ..... D25/48.4
D559,404 S * 1/2008 Chen et al. ..... D25/48.3
D564,668 S * 3/2008 Mock et al. ..... D25/48.4
D564,669 S * 3/2008 Mock et al. ..... D25/48.4
D564,670 S * 3/2008 Mock et al. ..... D25/48.4
D564,671 S * 3/2008 Mock et al. ..... D25/48.4
D564,672 S * 3/2008 Mock et al. ..... D25/48.4
D564,673 S * 3/2008 Mock et al. ..... D25/48.4
D565,194 S * 3/2008 Mock et al. ..... D25/48.4
D565,195 S * 3/2008 Mock et al. ..... D25/48.4
D565,196 S * 3/2008 Mock et al. ..... D25/48.4
D565,203 S * 3/2008 Dewitt ..... D25/138
7,383,872 B1 * 6/2008 Jella ..... 160/236
D573,264 S * 7/2008 Mock et al. ..... D25/48.4
D573,265 S * 7/2008 Mock et al. ..... D25/48.3
D574,971 S * 8/2008 Mock et al. ..... D25/138
D575,417 S * 8/2008 Mock et al. ..... D25/138
D575,418 S * 8/2008 Mock et al. ..... D25/138
D575,419 S * 8/2008 Mock et al. ..... D25/138
D575,420 S * 8/2008 Mock et al. ..... D25/138
D575,880 S * 8/2008 Mock et al. ..... D25/138
7,431,068 B1 * 10/2008 Jella ..... 160/236
D582,565 S * 12/2008 Colston et al. ..... D25/48.3
D582,566 S * 12/2008 Colston et al. ..... D25/48.3
D586,200 S 2/2009 Dewitt
D623,313 S * 9/2010 Maher ..... D25/48.3
7,900,682 B2 * 3/2011 Calvino, Jr. ..... 160/232
D668,784 S * 10/2012 Myles ..... D25/48.7
8,281,844 B1 * 10/2012 Zacchia ..... 160/201
D700,358 S * 2/2014 Myles ..... D25/48.7
D710,026 S * 7/2014 Myles ..... D25/48.7
D710,027 S * 7/2014 Myles ..... D25/48.7
D710,028 S * 7/2014 Myles ..... D25/48.7
D710,029 S * 7/2014 Myles ..... D25/48.7
2002/0100228 A1 * 8/2002 Yoder ..... 52/80.1
2002/0108325 A1 * 8/2002 Hulls et al. ..... 52/204.1
2003/0110718 A1 6/2003 Boisvert
2003/0188498 A1 * 10/2003 Lewkowitz ..... 52/208
2004/0011481 A1 * 1/2004 Jella ..... 160/236
2005/0016694 A1 * 1/2005 Jella ..... 160/236
2005/0050824 A1 3/2005 Warner, III
2005/0055906 A1 * 3/2005 Barnard ..... 52/204.1
2005/0055921 A1 * 3/2005 Vella ..... 52/311.1
2005/0056381 A1 * 3/2005 Truman ..... 160/133
2005/0092447 A1 * 5/2005 Mock ..... 160/201
2005/0194106 A1 * 9/2005 Scales ..... 160/201
2006/0027342 A1 2/2006 Maher
2006/0162875 A1 * 7/2006 Magill et al. ..... 160/201
2007/0022698 A1 2/2007 Forsland et al.
2007/0175602 A1 * 8/2007 Ni et al. ..... 160/201
2008/0040962 A1 * 2/2008 Gurren ..... 40/611.1
2008/0066399 A1 3/2008 Akdag et al.
2008/0135192 A1 * 6/2008 Truman ..... 160/229.1
2009/0025334 A1 * 1/2009 Aquilina et al. ..... 52/784.13
2009/0107054 A1 * 4/2009 Waller ..... 52/38
2009/0241422 A1 10/2009 Mock et al.
2009/0255636 A1 * 10/2009 Calvino, Jr. ..... 160/201
2009/0277109 A1 11/2009 Taylor et al.
2010/0218424 A1 * 9/2010 Maher ..... 49/70
2010/0251635 A1 * 10/2010 Barnard et al. ..... 52/127.6
2010/0269414 A1 * 10/2010 Horton ..... 49/197
2013/0097939 A1 * 4/2013 Blume ..... 49/506

* cited by examiner

GARAGE DOOR AND FAUX WINDOW FAçADE ASSEMBY

BACKGROUND OF THE INVENTION

The present invention relates to a garage door and faux window façade assembly, and in particular to a faux window façade assembly for retrofitting an existing garage door to improve the aesthetics thereof.

SUMMARY OF THE INVENTION

One aspect of the present invention is to provide a garage door and faux window façade assembly that comprises a door panel including an upper edge, a lower edge and a forwardly-facing surface, wherein the door panel is adapted to be mounted in a garage door opening partially defined by an overhead door structure, and a substantially triangularly-shaped clearance area defined by a first line segment substantially coplanar with the forwardly-facing surface of the door panel, and second and third line segments defined by a path of the overhead door structure relative to the door panel as the door panel moves between a closed position and an open position. The second line segment is proximate the upper edge of the door panel and the third line segment is proximate the lower edge of the door panel, while the clearance area is adapted to be free from abutment with the overall door structure as the door panel moves between the closed position and the open position. The clearance area includes a forward portion area defined by the first and second line segments and a ⅜ inch line that extends perpendicularly from the first line segment and intersects the second line segment. The garage door and faux window façade assembly further comprises a frame including at least a select one of a window aperture extending there through and a window recess formed therein, wherein the frame extends into the forward portion area of the clearance area at at least one location along a length of the frame.

Another aspect of the present invention is to provide a garage door and faux window façade assembly that comprises a door panel including an upper edge, a lower edge and a forwardly-facing surface, wherein the door panel is adapted to be mounted in a garage door opening partially defined by an overhead door member, and a substantially triangularly-shaped clearance area defined by a first line segment substantially coplanar with the forwardly-facing surface of the door panel, and second and third line segments defined by a path of the overhead door member relative to the door panel as the door panel moves between a closed position and an open position, wherein the second line segment is proximate the upper edge of the door panel and the third line segment is proximate the lower edge of the door panel, and wherein the clearance area is adapted to be free from abutment with the overhead door member as the door panel moves between a closed position and an open position. The garage door and faux window façade assembly further comprises a frame including at least a select one of a window aperture extending there through and a window recess formed therein, wherein the frame extends at least ⅞ of an inch into the clearance area, thereby providing an aesthetic depth to the frame relative to the door panel.

Yet another aspect of the present invention is to provide a garage door and faux window façade assembly that comprises a door panel having a forwardly-facing surface, and a frame secured to the forwardly-facing surface of the door panel, the frame comprising at least a select one of a window aperture extending there through and a window recess formed therein, and an outer frame portion extending about an outer periphery of the frame and including a forwardly-facing aesthetic surface and a rearwardly-facing surface abutting the forwardly facing surface of the garage door panel, wherein the rearwardly-facing surface includes an offset adapted to receive excess adhesive placed between the rearwardly-facing surface of the frame and the forwardly-facing surface of the door panel.

Another aspect of the present invention is to provide a garage door and faux window façade assembly that comprises a door panel having a forwardly-facing surface, a substantially flat opaque member, and a frame coupled with the opaque member and secured to the forwardly-facing surface of the door panel. The frame comprises a window aperture extending there through such that the opaque member is visible through the window aperture, and a frame portion extending about an outer periphery of the window aperture and including a forwardly-facing aesthetic surface and a rearwardly-facing surface abutting the opaque member, wherein the rearwardly-facing surface includes an offset adapted to receive excess adhesive placed between the rearwardly-facing surface of the frame portion and the forwardly-facing surface of the opaque member.

Yet another aspect of the present invention is to provide a garage door and faux window façade assembly that comprises a door panel having a forwardly-facing surface, a substantially flat opaque member, and a frame coupled with the opaque member and secured to the forwardly-facing surface of the door panel. The frame comprises a window aperture extending there through such that the opaque member is visible through the window aperture, and an outer frame portion extending about an outer periphery of the frame and including a forwardly-facing aesthetic surface and a rearwardly-facing surface abutting the door panel, wherein at least a portion of the outer frame portion extending about the outer periphery of the window aperture includes a hollow interior, and wherein the hollow interior is at least partially filled with a structural foam.

Still yet another aspect of the present invention is to provide a garage door and faux window façade assembly that comprises a door panel having a forwardly-facing surface, a substantially flat backing member, and a frame coupled with the backing member and secured to the forwardly-facing surface of the door panel. The door frame comprises a window aperture extending there through, wherein the backing member is visible through the window aperture, a temporary attachment member temporarily attaching the backing member to the frame during assembly of the backing member with the frame, and a permanent attachment member permanently attaching the backing member to the frame.

Yet another aspect of the present invention is to provide a garage door and faux window façade assembly that comprises a door panel having a forwardly-facing surface, and a frame secured to the forwardly-facing surface of the door panel, wherein the frame comprises at least a select one of a window aperture extending there through and a window recess formed therein, a forwardly-facing aesthetic surface, and a rearwardly-facing surface facing the forwardly-facing surface of the door panel, and having at least one boss extending rearwardly from the rearwardly-facing surface of the frame and abutting the forwardly-facing surface of the door panel when the frame is secured to the door panel.

Another aspect of the present invention is to provide a garage door and faux window façade assembly that comprises a door panel having a forwardly-facing surface, a substantially flat opaque member, and a frame coupled with the opaque member and secured to the forwardly-facing surface of the door panel. The door frame comprises a window aperture extending through the frame such that the opaque member is visible through the window aperture, a forwardly-facing aesthetic surface, and a rearwardly-facing surface facing the forwardly-facing surface of the door panel, and having at least one alignment member extending rearwardly from the rearwardly-facing surface of the frame and abutting the opaque member, thereby aligning the opaque member with respect to the frame during assembly of the opaque member with the frame.

Yet another aspect of the present invention is to provide a garage door and faux window façade assembly comprising a door panel having a forwardly-facing surface, a substantially flat opaque member, and a frame coupled with the backing member and secured to the forwardly-facing surface of the door panel, the frame including a window aperture extending through the frame such that the backing member is visible through the window aperture, wherein the backing member is in-molded within the frame.

The principle objects of the present invention are to provide a durable, uncomplicated design, that may be easily and quickly assembled with relatively common tools. The present invention is efficient in its use, economical to manufacture, capable of a long operating life, and provides a significant improvement to the aesthetics of commonly employed garage doors, and is particularly well adapted for the proposed use.

These and other advantages of invention will be further understood and appreciated by those skilled in the art by reference to the following written specification, claims and appended drawings.

DETAILED DESCRIPTION OF PREFERRED EMBODIMENTS

Figure 1:
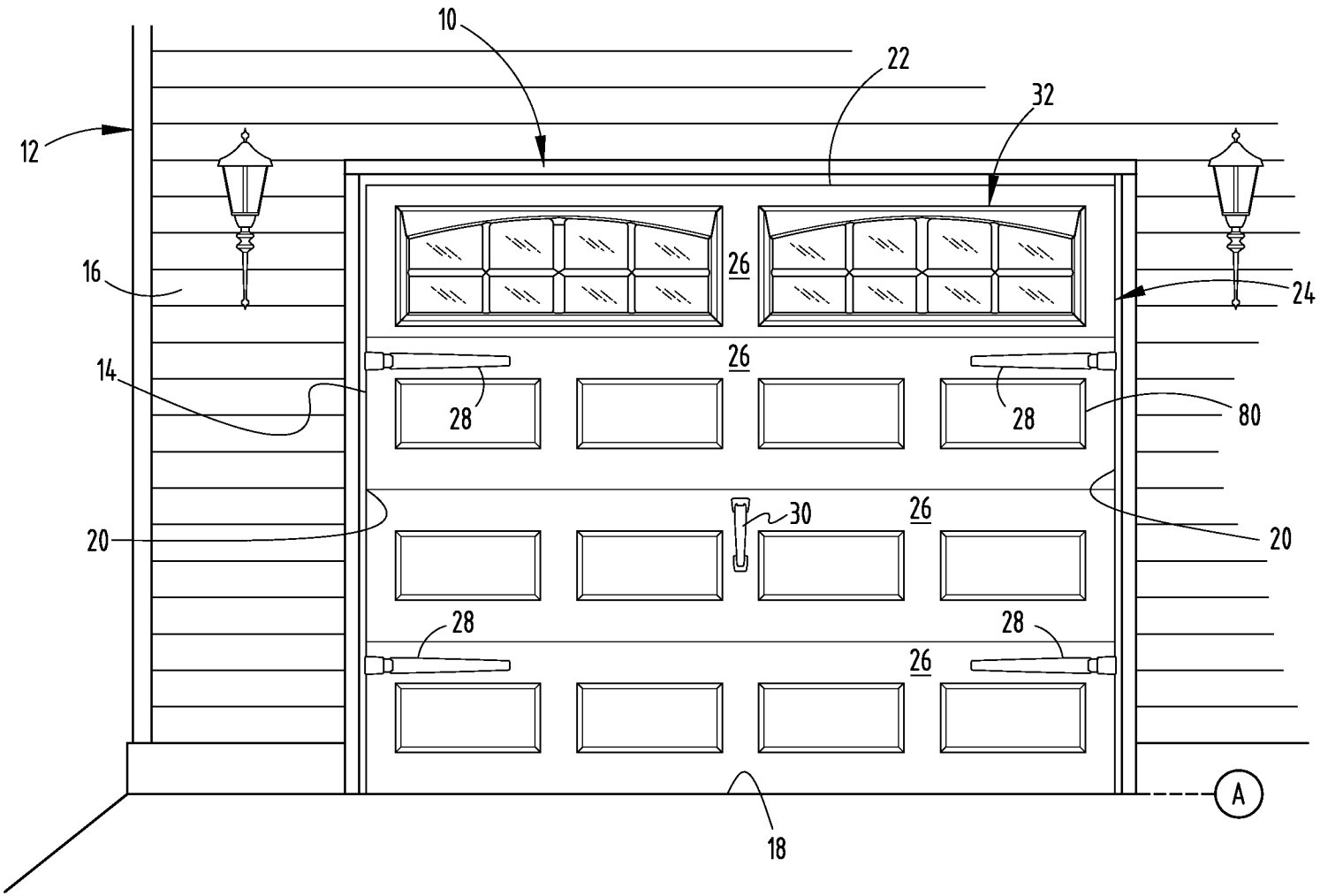
FIG. 1 is a front elevational view of a garage door and faux window façade assembly embodying the present invention, and located within a home construction, wherein the garage door is in a fully closed position.
Figure 2:
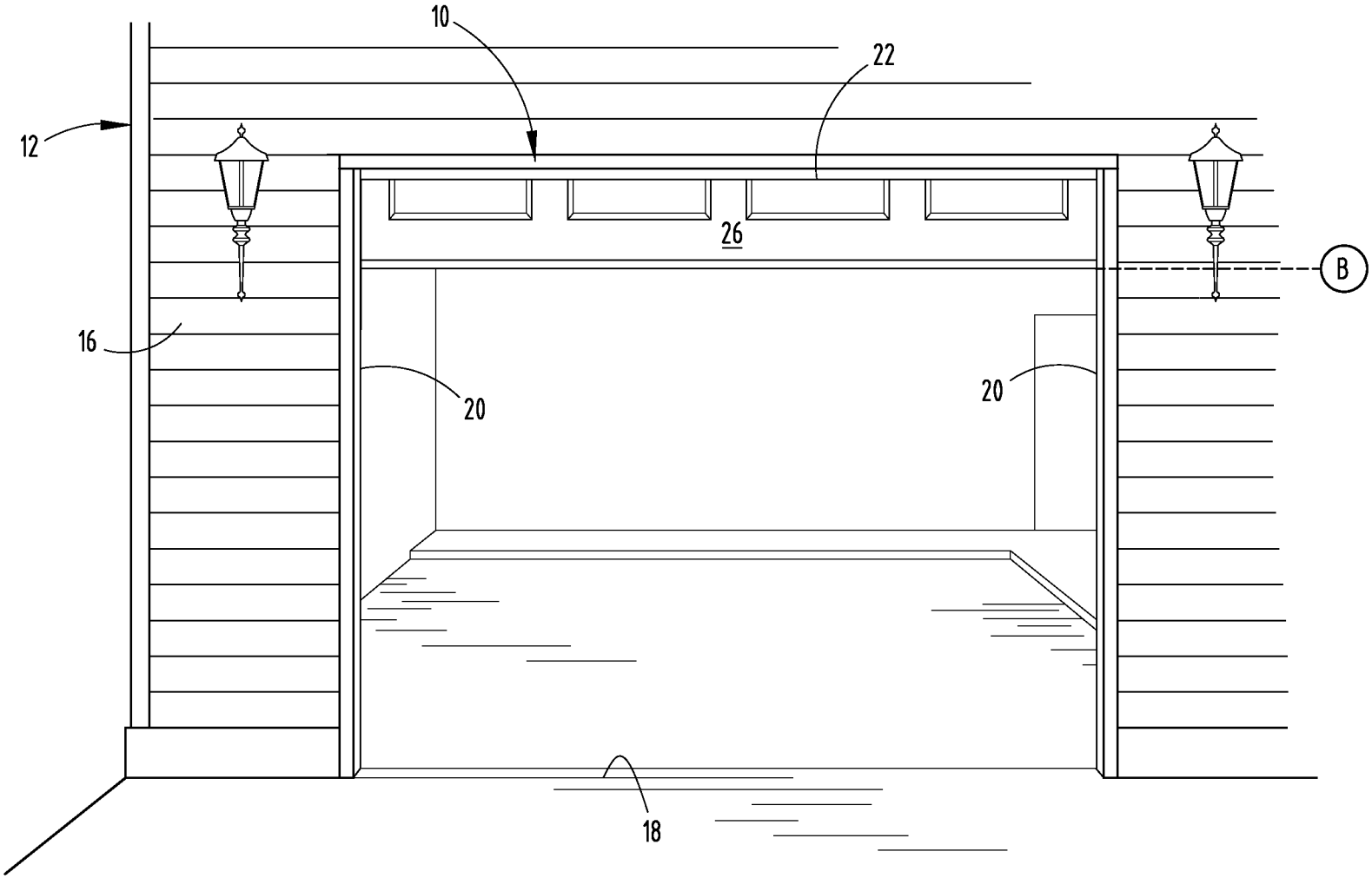
FIG. 2 is a front elevational view of the garage door and faux window façade assembly, wherein the garage door is in a fully open position.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIGS. 1 and 2) generally designates a garage door and faux window façade assembly embodying the present invention. In the illustrated example, the assembly 10 is utilized within a house or a residential construction 12, however the present invention assembly 10 is also well suited for use in commercial construction. The house construction 12 includes a door opening 14 located within an outer wall 16. The door opening 14 is defined by a ground or floor surface 18, side door frame members 20, and an overhead door structure or member 22. The overhead door structure or member 22 may comprise a solid frame member or an elastically deformable weather seal or gasket, as discussed below. A garage door assembly 24 is positioned within the door opening 14, and is movable between a fully closed position A (FIG. 1), and a fully opened position B (FIG. 2). The garage door assembly 24 includes a plurality of vertically oriented garage door panels 26 coupled to one another by a plurality of hinges (not shown) in a manner as known in the art. Also illustrated in FIG. 1 are full-type hinges 28 and a handle that each include a complementary aesthetic finish to that of other portions of the garage door and faux window façade assembly 10.

Figure 3:
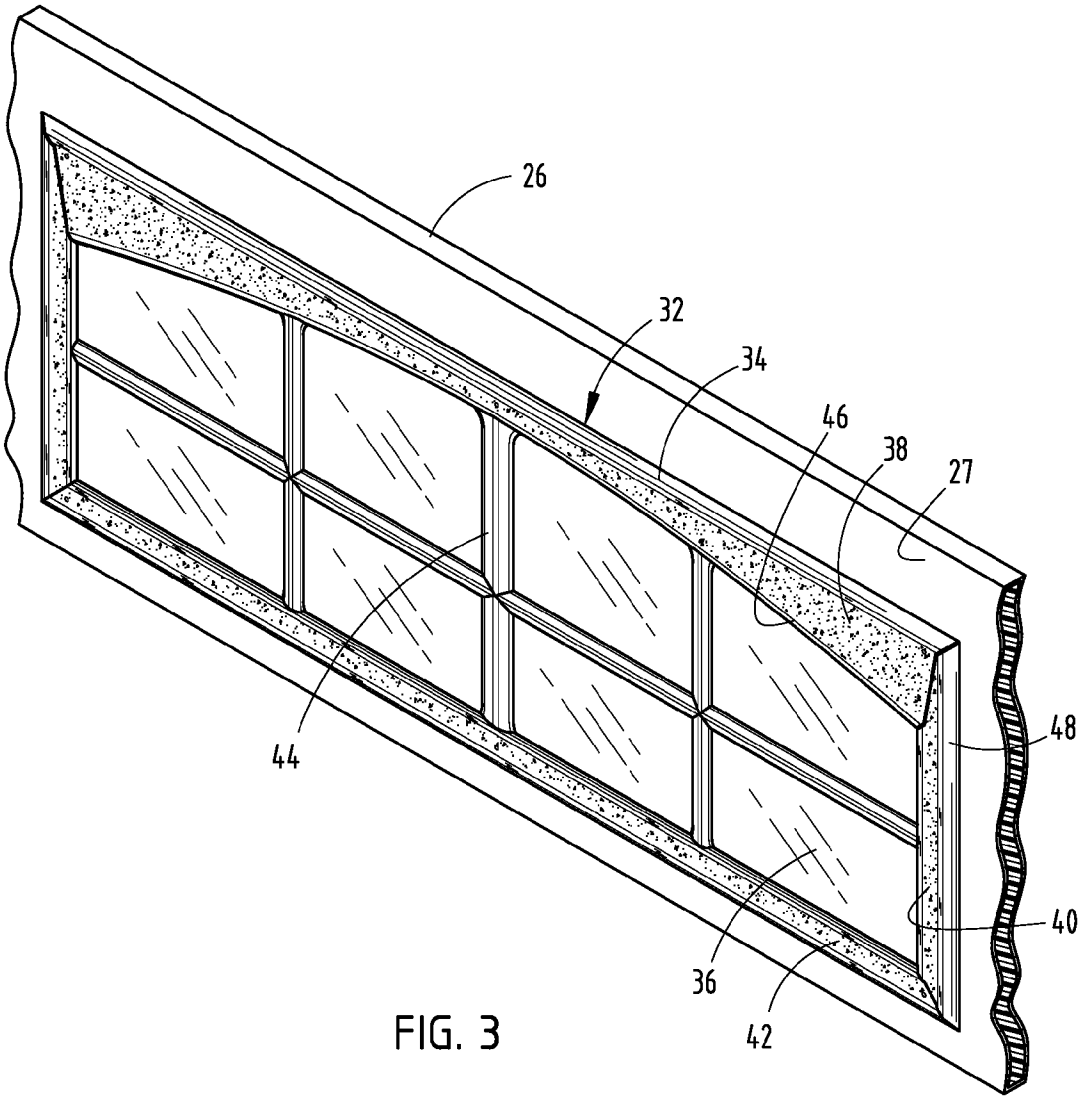
FIG. 3 is a perspective view of a garage door panel of the garage door and faux window façade assembly with a faux window façade assembly attached thereto.

As best illustrated in FIGS. 1 and 3, the assembly 10 further includes a faux window façade assembly 32 adapted to be secured to the outer surface 27 of an associated garage door panel 26. The assembly 32 includes a frame member 34, an opaque backing member 36, and fastening hardware as discussed below. The frame member 34 includes a horizontally extending upper frame portion 38, a pair of side frame portions 40 extending vertically downward from the upper frame portion 38, a bottom frame portion 42 extending horizontally between the side frame portions 40, and a plurality of intersecting intermediate frame portions 44 that extend between the upper frame portion 38, the bottom frame portion 42, and the side frame portions 40 and cooperate to divide a general window opening 46 into a plurality of segmented openings.

Figure 4:
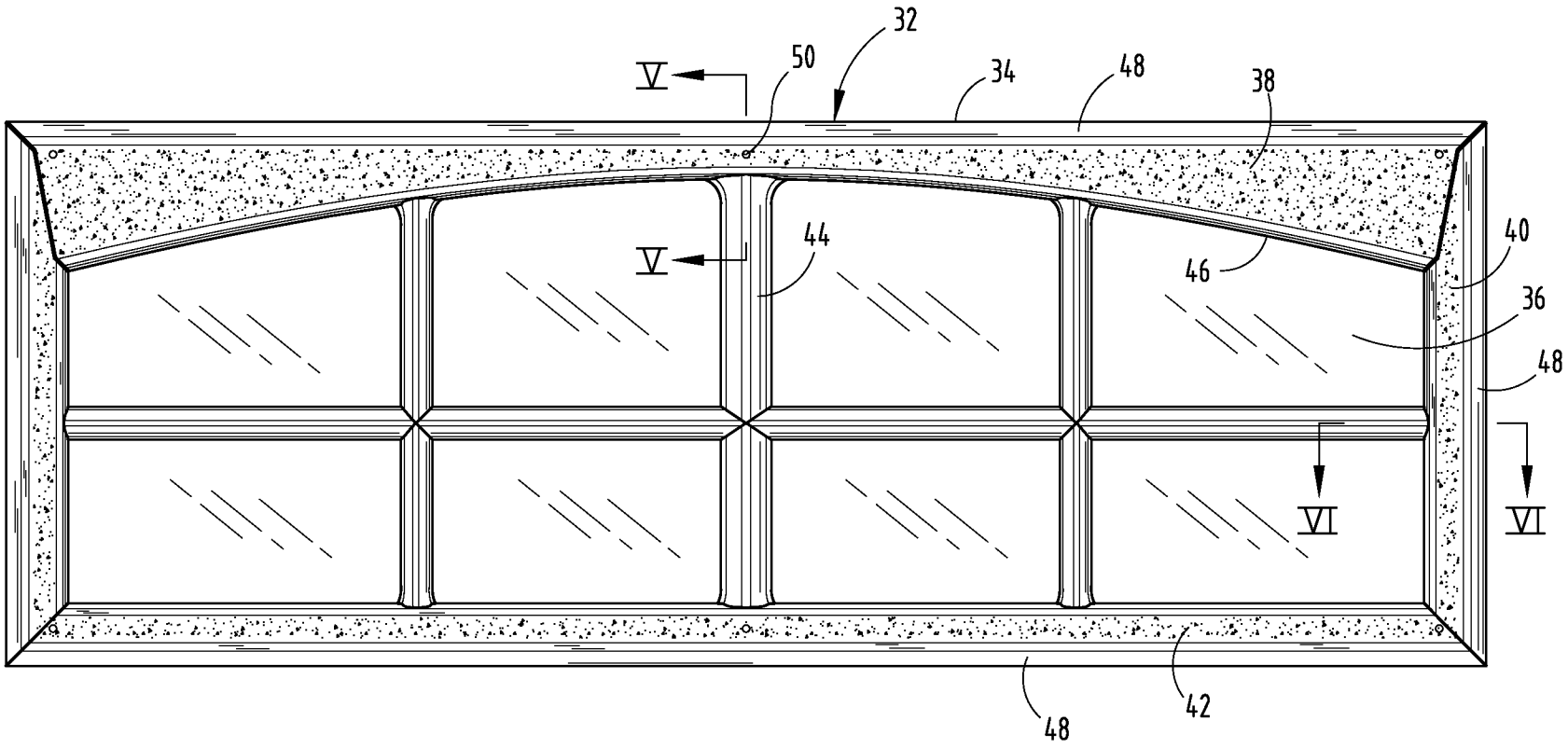
FIG. 4 is a front elevational view of the faux window façade assembly.
Figure 5:
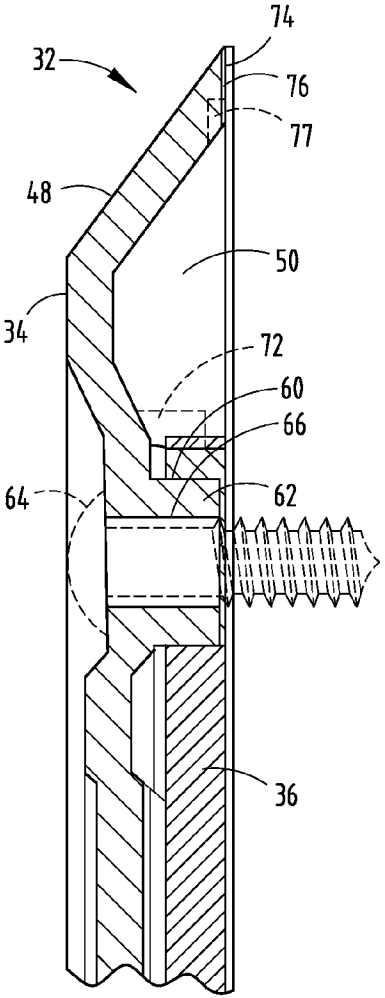
FIG. 5 is a cross-sectional, partial side elevational view of the faux window façade assembly 32, taken along the line V-V, FIG. 4.

As best illustrated in FIGS. 3-5, each of the upper frame portion 28, the side frame portions 40, and the bottom frame portion 42 includes beveled outer edges 48 that increase the aesthetic appeal of the overall assembly 32 and add a visual sense of depth thereto. Further, the upper frame portion 38, the side frame portions 40 and the bottom frame portion 42 are each shaped as to provide a hollow interior space 50 that may be filled with a foamable material, such as a silicone rubber, e.g., vulcanizing (RTV) foam/sealant, thereby increasing the structural integrity of the overall frame member 34, as well as improving the sound qualities of the frame member 34 should the frame member 34 be struck on the outer surface thereof. The frame member 34 is preferably injection molded of a polycarbonate material, such as a combination of polycarbonate and ABS. An outer decorative surface of the frame member 34 is covered with a satin finish metal plating, such as those described n U.S. Pat. No. 6,749,946, entitled Method and Composition for Metallic Finishes, the disclosure of which is incorporated herein by reference. The outer surface of the assembly 32 can also be painted, textured or otherwise finished for a particular desired appearance.

The opaque backing member 36 preferably comprises an acrylic sheet tinted so as to prevent the majority of light from passing there through, thereby providing the visual appearance of a garage door assembly 24 having a door panel 26 with an actual window passage passing there through, even though the garage door panel 26 is a solid panel with no window aperture. Although a single, opaque acrylic sheet is illustrated in the present example, a series of layered sheets providing the same aesthetic appearance may also be utilized. Further, in certain applications, a clear acrylic sheet may also be utilized. Moreover, the assembly 32 may include a frame member wherein the plurality of segmented openings of the window opening 46 are replaced with a plurality of recesses such that no through window exist. These recesses may subsequently be coated with a material such as a high-gloss paint, thereby giving the appearance of a window opening.

In assembly, the backing member 36 is temporarily secured to a rear surface 52 of the frame member 34 by two-sided tape. Of course, other temporary securing means may also be utilized, such as glues, adhesives, mechanical fasteners, and the like. In instances where an adhesive is used and is placed along an edge surface 56 of the frame member 34 that abuts the backing member 36, a channel 58 is provided to receive excess adhesive, thereby preventing adhesive from spreading into an area where the adhesive would be seen subsequent to final assembly.

Figure 8:
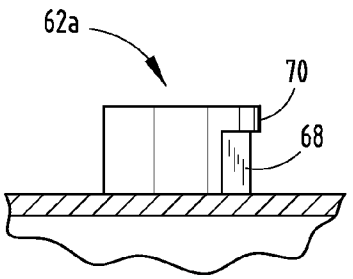
FIG. 8 is a side elevational view of the alternative embodiment of the boss.
Figure 7:
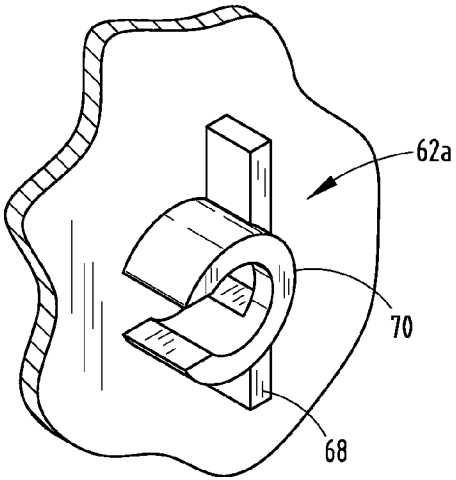
FIG. 7 is a perspective view of an alternative embodiment of a boss.

The backing member 36 is aligned with the frame member 34 by aligning apertures 60 extending through the backing member 36 with rearwardly extending, corresponding bosses 62 of the frame member 34. The backing member 36 is permanently secured to the frame member 34, and the faux window façade assembly 32 is then permanently secured to the outer surface 27 of the corresponding garage door panel 26 by a plurality of screws 64 that extend through apertures 66 of the bosses 34 and into the garage door panel 26. Alternatively, and as best illustrated in FIG. 7, each boss 62A is configured to have a C-shaped cross sectional configuration. Further, each boss 62A includes outwardly extending alignment tabs 68 that abut an outer edge of the backing member 36, thereby properly aligning the backing member 36 with respect to the frame member 34. Further, each boss 62A (FIG. 8) includes an inwardly extending snap tab 70 that allows the backing member 36 to be secured to the frame member 34 via a snap-type arrangement.

Alternatively, or in combination with other alignment methods described above, a plurality of inwardly-extending alignment tabs 72 (FIGS. 5 and 6) may be spaced along the periphery of the frame member 34 and aligned so as to abut an outer edge of the backing member 36, thereby properly aligning the backing member 36 with the frame member 34.

Figure 6:
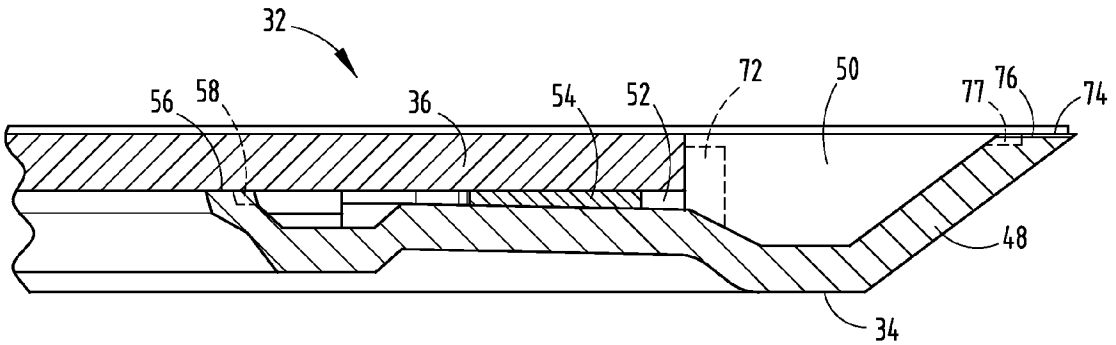
FIG. 6 is a cross-sectional, partial top plan view of the faux window façade assembly taken along the line VI-VI, FIG. 4.

An outer peripheral edge surface 74 (FIG. 5) of the frame member 34 is sealed to the outer surface 27 of the associated door panel 26 by an RTV seal 76 so as to prevent water and debris from entering between the faux window façade assembly 32 and the door panel 26. As best illustrated in FIGS. 5 and 6, a longitudinally extending channel 77 is provided along the edge surface 74 to receive excessive adhesive or seal material therein, thereby preventing the sealing material from escaping beyond the outer most edges of the frame member 34 and concealing the same subsequent to assembly and final installation.

Figure 9:
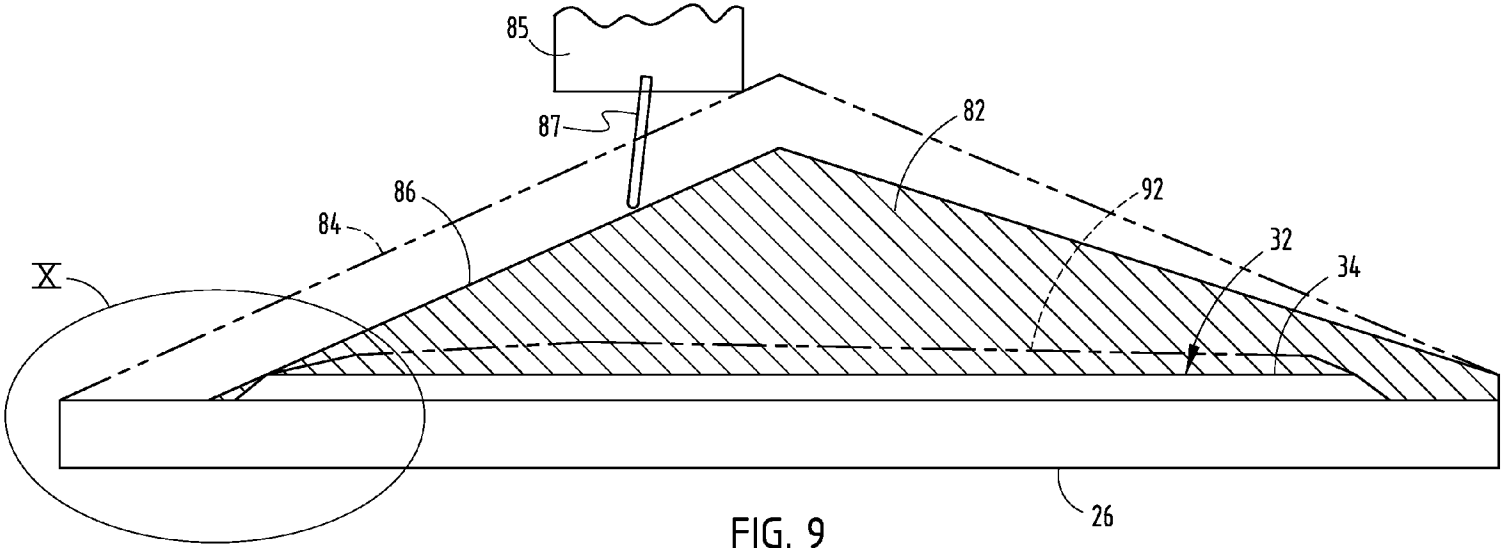
FIG. 9 is a schematic view of the door panel and faux window façade assembly.

The present inventive faux window façade assembly 32 is sized so as to maximize the aesthetic properties and visual improvements to the overall garage door and faux window façade assembly 10. Further, many standard garage door panels 26 include embossed or inmolded panels 80 (FIG. 1) spaced across the outer surface 27 thereof. The present inventive faux window façade assembly 23 and in particular the frame member 34 is sized so as to completely cover an embossed panel 80. Also a consideration is the clearance necessary between the outer surface 27 of any given garage door panel 26 and the overhead door structure or member 22 as the garage door assembly 24 is moved between the closed position A and the open position B. As best illustrated in FIG. 9, a clearance area 82 is defined by the path of the overhead door structure or member 22 with respect to the garage door panel 26 as the garage door assembly 24 is moved between the closed position A and the open position B. The clearance area 82 is an area that is free from abutment with the overhead door structure 22 as the door is moved between the closed position A and the open position B. A top header crash line 84 represents the path of a rigid overhead top header 85 of the door frame relative to the garage door panel 26, while a top seal crash line 86 represents the path of a top seal 87 of the garage door frame relative to the garage door panel 26. As noted above, the present inventive faux window façade assembly 32 improves the aesthetic qualities of the overall garage door and faux window façade assembly 10 by utilizing a significant amount of the available clearance area 82.

Figure 10:
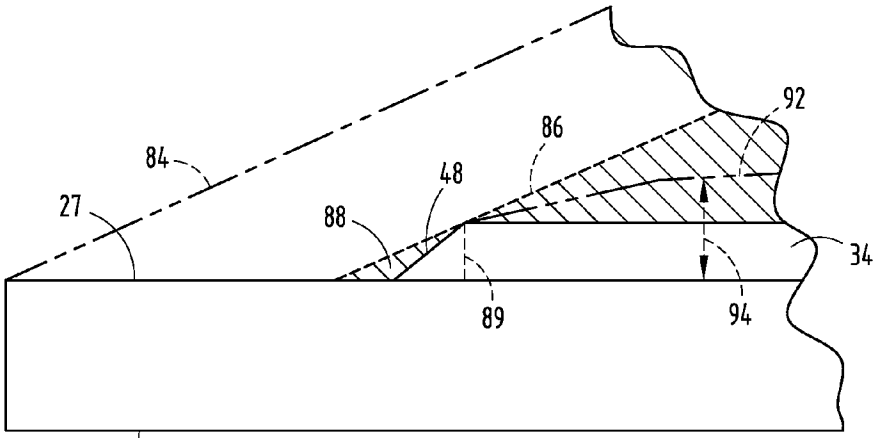
FIG. 10 is an enlarged partial view of the schematic of FIG. 9, taken of the area X, FIG. 9.

In the illustrated example, the clearance area 82 includes a forward portion 88 defined by the outer surface 27 of the door panel 26, the top seal crash line 86, and a line segment 89 extending perpendicularly from the outer surface 27 of the door panel 26 and intersecting the top seal crash line 86. In the illustrated example the line segment is ⅜ inch in length. The frame member 34 is sized and positioned such that the beveled outer edges 48 extend into the forward portion 88 of the clearance area 82. Preferably, the beveled outer edge 48 extends into at least 10% of the forward portion 88 of the clearance area 82 at at least one location along a length of the frame member 34, more preferably into at least a majority of the forward portion area 88 at at least one location along the length of the frame, and most preferably into at least 70% of the forward portion area 88 at at least one location along the length of the frame. Moreover, at least a portion of the frame member 34 may be formed so as to extend further away from the outer surface 27 of the panel 26 and into the clearance area 82 so as to provide a visual depth to the frame member 34 thereby maximizing the aesthetic properties thereof. As best illustrated in FIGS. 9 and 10, the outermost surface 92 of the frame member 34 may preferably extend at least ⅞ inch into the clearance area in a direction perpendicular from the outer surface 27 of the door panel 26 as represented by line 94, more preferably at least 1 inch from the outer surface 27, and most preferably at least 1½ inches from the outer surface 27.

The present inventive garage door and faux window façade assembly greatly improves the aesthetic quality of garage door assemblies, particularly those that include solid garage door panels, or those panels that do not include window assemblies therein. Further, the present inventive faux window façade assembly is adapted to be easily retrofitted unto existing garage door panels, including many panels of standard industry size. The garage door and faux window façade assembly is durable and capable of a long operating life, may be easily and quickly retro-fitted onto existing garage door assemblies with relatively common tools, and is particularly well adapted for the proposed use.

In the foregoing description, it will be readily appreciated by those skilled in the art that modifications may be made to the invention without departing from the concept disclosed herein. Such modifications are to be considered as included in the following claims, unless these claims by their language expressly state otherwise.

The invention claimed is:

1. A garage door and faux window façade assembly, configured to enter a substantially triangular clearance area between an overhead garage door frame and the faux window façade assembly attached to the garage door while avoiding contact with an overhead door structure when the garage door is opening and closing, the garage door and faux window façade assembly comprising:

a garage door panel including an upper edge, a lower edge and a forwardly-facing surface which faces in a direction outside the garage door panel, wherein the garage door panel is configured to be mounted in a garage door opening which is partially defined by the overhead garage door frame;

the substantially triangularly-shaped clearance area being defined by a first line segment substantially coplanar with the forwardly-facing surface of the garage door panel, and second and third line segments of the substantially triangular clearance area being defined by a path of the garage door panel relative to the overhead door structure as the garage door panel moves between a closed position and an open position, wherein the second line segment is proximate the upper edge of the garage door panel and the third line segment is proximate the lower edge of the garage door panel, the substantially triangular-shaped clearance area being configured to be free from abutment with the overhead door structure as the garage door panel moves between a closed position and an open position, and wherein the substantially triangular clearance area includes a forward portion area defined by the first and second line segments and a ⅜ inch line extending perpendicularly from the first line segment and intersecting the second line segment;

a faux window façade assembly having a frame including at least a select one of a window aperture extending there through and a window recess formed therein, wherein the faux window façade assembly frame extends into the forward portion area of the substantially triangular-shaped clearance area in at least one location along a length of the faux window façade assembly frame;

wherein the garage door panel with the faux window façade assembly mounted thereto is configured to open and close without the faux window façade assembly contacting the overhead door structure.

2. The assembly of claim 1, wherein the faux window façade assembly frame extends into at least 10% of the forward portion area of the substantially triangular clearance area in at least the one location along the length of the faux window façade assembly frame.

3. The assembly of claim 2, wherein the faux window façade assembly frame extends into at least 70% of the forward portion area of the substantially triangular clearance area in at least the one location along the length of the faux window façade assembly frame.

4. The assembly of claim 1, wherein the faux window façade assembly frame extends into at least a majority of the forward portion area of the substantially triangular clearance area in at least the one location along the length of the faux window façade assembly frame.

5. The assembly of claim 1, further including:

an opaque member coupled with the faux window façade assembly frame such that the opaque member is visible through the window aperture.

6. The assembly of claim 5, wherein the opaque member comprises an acrylic sheet.

7. The assembly of claim 1, wherein at least a portion of the window recess is covered by a high gloss paint.

8. The assembly of claim 1, wherein at least a portion of the faux window façade assembly frame includes a hollow interior.

9. A garage door and faux window façade assembly configured to enter a substantially triangular clearance area between an overhead garage door frame and the faux window façade assembly attached to the garage door while avoiding contact with an overhead door structure when the garage door is opening and closing, the garage door and faux window façade assembly, comprising:

a garage door panel including an upper edge, a lower edge and a forwardly-facing surface, facing in a direction outside of the garage door panel, wherein the garage door panel is configured to be mounted in a garage door opening partially defined by the overhead door structure;

the substantially triangularly-shaped clearance area being defined by a first line segment substantially coplanar with the forwardly-facing surface of the garage door panel, and second and third line segments of the substantially triangular shaped clearance area defined by a path of the overhead door structure relative to the garage door panel as the garage door panel moves between a closed position and an open position, wherein the second line segment of the substantially triangular clearance area is proximate the upper edge of the garage door panel and the third line segment of the substantially triangular clearance area is proximate the lower edge of the garage door panel, and wherein the substantially triangular clearance area is configured to be free from abutment with the overhead door structure as the garage door panel moves between a closed position and an open position; and a faux window façade assembly frame including at least a select one of a window aperture extending there through and a window recess formed therein, wherein the faux window façade assembly frame extends at least ⅞ of an inch into the substantially triangular clearance area, thereby providing an aesthetic depth to the faux window façade assembly frame relative to the garage door panel;

wherein the garage door panel with the faux window façade assembly mounted thereto is configured to open and close without the faux window façade assembly contacting the overhead door structure.

10. The assembly of claim 9, wherein the faux window façade assembly frame extends into at least 1 inch into the substantially triangular clearance area, thereby providing an aesthetic depth to the faux window façade assembly frame relative to the garage door panel.

11. The assembly of claim 9, further including:

an opaque member coupled with the faux window façade assembly frame such that the opaque member is visible through the window aperture.

12. The assembly of claim 11, wherein the opaque member comprises an acrylic sheet.

13. The assembly of claim 9, wherein at least a portion of the window recess is covered by a high gloss paint.

14. The assembly of claim 9, wherein at least a portion of the faux window façade assembly frame includes a hollow interior.

15. A garage door and faux window façade assembly configured to enter a clearance area between an overhead garage door frame and the faux window façade assembly attached to the garage door while avoiding contact with the overhead garage door frame when the garage door is opening and closing, the garage door and faux window façade assembly, comprising:

a garage door panel having a forwardly-facing surface;

a substantially flat opaque member; and a faux window façade assembly frame coupled with the opaque member and secured to the forwardly-facing surface of the garage door panel, the faux window façade assembly frame comprising:

a window aperture extending there through such that the opaque member is visible through the window aperture; and an outer frame portion extending about an outer periphery of the window aperture and including a forwardly-facing aesthetic surface and a rearwardly-facing surface abutting the opaque member, wherein the rearwardly-facing surface includes an offset channel configured to receive excess adhesive placed between the rearwardly-facing surface of the faux window façade assembly frame portion and the forwardly-facing surface of the opaque member, the outer frame portion extending about the outer periphery of the window aperture includes a hollow interior, and wherein at least a portion of the offset channel of the outer frame portion and at least a portion of the hollow interior of the outer frame portion are positionally offset from one another;

wherein the garage door panel with the faux window façade assembly mounted thereto is configured to open and close without the faux window façade assembly contacting the overhead garage door frame.

16. The assembly of claim 15, wherein the offset channel extends longitudinally along the at least a portion of the faux window façade assembly frame portion extending about the outer periphery of the window aperture.

17. The assembly of claim 15, wherein the opaque member comprises an acrylic sheet.

18. A garage door and faux window façade assembly configured to enter a clearance area between an overhead garage door frame and the faux window façade assembly attached to the garage door while avoiding contact with the overhead garage door frame when the garage door is opening and closing, the garage door and faux window façade assembly, comprising:

a garage door panel having a forwardly-facing surface; and a faux window façade assembly frame secured to the forwardly-facing surface of the garage door panel, the faux window façade assembly frame comprising:

at least a select on of a window aperture extending there through and a window recess formed therein;

a forwardly-facing aesthetic surface;

a rearwardly-facing surface facing the forwardly-facing surface of the garage door panel, and having at least one boss extending rearwardly from the rearwardly-facing surface of the faux window façade assembly frame and abutting the forwardly-facing surface of the garage door panel when the faux window façade assembly frame is secured to the garage door panel; and a substantially flat backing member attached to the faux window façade assembly frame such that the backing member is visible through the window aperture, wherein the backing member abuts the at least one boss to properly align the backing member with respect to the faux window façade assembly frame;

wherein the at least one boss is integral with the frame, and wherein the at least one boss includes a mounting aperture extending there through that receives a mounting screw therein that mounts the frame to the door panel, and wherein the garage door panel with the faux window façade assembly mounted thereto is configured to open and close without the faux window façade assembly contacting the overhead garage door frame.

19. The assembly of claim 18, wherein the at least one boss positively engages the backing member, thereby securing the backing member to the frame.

20. The assembly of claim 19, wherein the at least one boss includes a plurality of bosses spaced about an outer periphery of the backing member, and wherein the positive engagement between the backing member and the faux window façade assembly frame includes a snap connection.

21. A garage door, an overhead garage doorframe and faux window façade assembly configured to enter a substantially triangular clearance area between the overhead garage door frame and the faux window façade assembly attached to the garage door while avoiding contact with the overhead garage door frame when the garage door is opening and closing, the garage door, overhead garage door frame and faux window façade assembly comprising:

a garage door panel including an upper edge, a lower edge and a forwardly-facing surface which faces in a direction outside the garage door panel, wherein the garage door panel is mounted in a garage door opening which is partially defined by the overhead garage door frame; the substantially triangularly-shaped clearance area being defined by a first line segment substantially coplanar with the forwardly-facing surface of the garage door panel, and second and third line segments of the substantially triangular clearance area being defined by a path of the garage door panel relative to the overhead garage door frame as the garage door panel moves between a closed position and an open position;

wherein the second line segment is proximate the upper edge of the garage door panel and the third line segment is proximate the lower edge of the garage door panel, the substantially triangular-shaped clearance area being configured to be free from abutment with the overhead garage door frame as the garage door panel moves between a closed position and an open position, and wherein the substantially triangular clearance area includes a forward portion area defined by the first and second line segments and a ⅜ inch line extending perpendicularly from the first line segment and intersecting the second line segment;

a faux window façade assembly having a frame including at least a select one of a window aperture extending there through and a window recess formed therein, wherein the faux window façade assembly frame extends into the forward portion area of the substantially triangular-shaped clearance area in at least one location along a length of the faux window facade assembly frame;

wherein the garage door panel with the faux window façade assembly mounted thereto is configured to open and close without the faux window façade assembly contacting the overhead garage door frame.

* * * * *